United States Patent [19]

Erbele et al.

[11] 4,035,018

[45] July 12, 1977

[54] DEVICE FOR DISTRIBUTING CONDITIONED AIR

[75] Inventors: Kurt Erbele, Asperg, Germany; Antonio Castelli, Bologna, Italy

[73] Assignee: Castelli KG, Aldingen, Germany

[21] Appl. No.: 623,380

[22] Filed: Oct. 17, 1975

[30] Foreign Application Priority Data

Oct. 22, 1974 Germany ..... 2450092

[51] Int. Cl.[2] ..... A47C 7/72

[52] U.S. Cl. ..... 297/180; 297/217; 98/2.03; 98/DIG. 11; 62/244

[58] Field of Search ..... 98/1, 37, 2.03, 2, DIG. 11; 62/244; 297/180, 217; 219/217

[56] References Cited

U.S. PATENT DOCUMENTS

| | | | |
|---|---|---|---|
| 374,424 | 12/1887 | Ober | 98/DIG. 11 |
| 1,750,873 | 3/1930 | Buck et al. | 98/DIG. 11 |
| 2,055,843 | 9/1936 | Helfinstine | 98/2.03 |
| 2,347,141 | 4/1944 | Wedehoff | 98/2.03 |
| 2,521,091 | 9/1950 | Pophal | 297/180 |
| 2,623,448 | 12/1952 | Runefolt | 297/180 |
| 2,852,998 | 9/1958 | Serra | 297/180 |
| 3,919,926 | 11/1975 | Yamada | 98/2.03 |

FOREIGN PATENT DOCUMENTS

| | | | |
|---|---|---|---|
| 900,383 | 12/1953 | Germany | 98/DIG. 11 |
| 575,764 | 4/1958 | Italy | 62/244 |

*Primary Examiner*—William F. O'Dea
*Assistant Examiner*—Henry C. Yuen
*Attorney, Agent, or Firm*—Walter Becker

[57] ABSTRACT

A device for distributing conditioned air over a row of chairs, especially over a row of individual chairs, while at least a portion of the seats of a row of seats is mounted on a common supporting beam. The conditioned air is passed through the supporting beam designed as a hollow body. Provided on the supporting beam are air outlet devices for discharging the conditioned air into the space or room to be air conditioned.

4 Claims, 4 Drawing Figures

10
13
23
11
14
24
12
15
25
20
16
22
17
19
18
21
26
20
19
26
20
19

DEVICE FOR DISTRIBUTING CONDITIONED AIR

The present invention relates to air conditioning and more specifically, to a device for distributing conditioned air over a row of chairs, especially a row of seats formed by individual chairs, while at least one portion of the seats of a row of seats is mounted on a common supporting beam.

With heretofore known devices of this type, individual air feeding conduits are provided which feed air to each of the seats of the row of chairs. Due to the plurality of air feeding lines, devices of this type require a great number of structural elements. In addition thereto, the mounting of such devices is difficult and time consuming and therefore expensive.

It is an object of the present invention to develop a device which is simple and cost saving and which, nevertheless, will furnish a very satisfactory air conditioning of the respective space.

It is a still further object of this invention to provide an arrangement of the type set forth in the preceding paragraph, which will make it possible that parts of the row of chairs, which parts are provided anyhow in connection with the arrangement of the chairs can be taken advantage of for distributing the conditioned air.

These and other objects and advantages of the invention will appear more clearly from the following specification, in connection with the accompanying drawings, in which:

FIG. 1 shows an arrangement of individual seats on a supporting beam and illustrates the feeding of the conditioned air through the supporting beam.

FIG. 1*a* shows an arrangement according to the invention for chairs on a step-shaped beam.

The device according to the present invention is characterized primarily in that the conditioned air is conveyed through the supporting beam which is designed as hollow body, and is furthermore characterized in that the supporting beam is provided with air outlet devices for discharging conditioned air to the space to be air conditioned.

Figures 1, 1A:
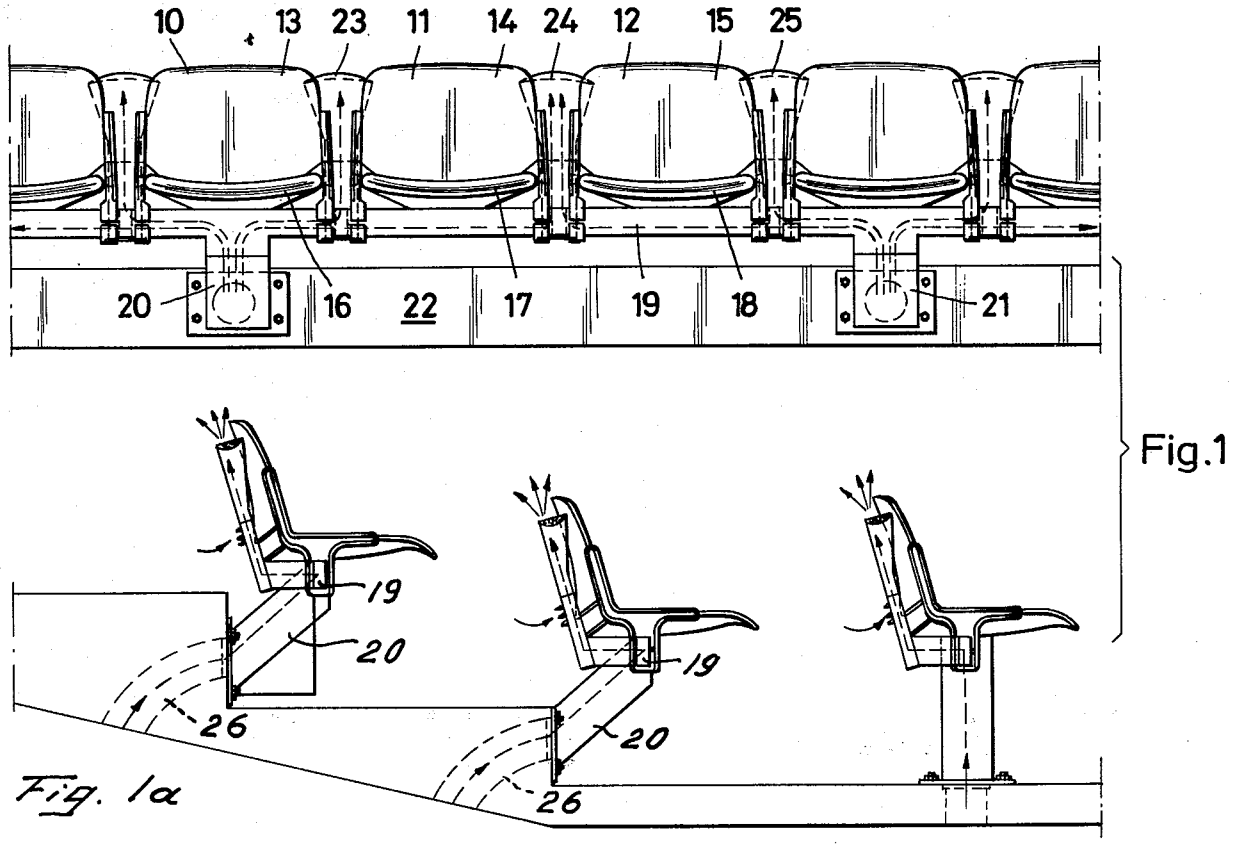

Referring now to the drawings in detail, FIG. 1 shows a row of individual seats 10, 11 and 12. Each of the individual seats 10, 11 and 12 has a back 13, 14 and 15 respectively and a seat 16, 17 and 18, respectively. Said individual seats are mounted on a common supporting beam 19 which is hollow. The supporting beam 19 is connected to hollow supports 20, 21 which, as will be evident from FIG. 2, extend at an incline to a stair step 22 and are fixedly mounted thereon. The supporting beam 19 is provided with air discharging devices which are designed as air funnels 23, 24 and 25 respectively. The air outlet devices may, however, also have any other suitable shape. The air funnels 23, 24 and 25 are provided between the backs 13, 14, and 15 respectively of the individual seats 10, 11, and 12 respectively and have their outer shape formed in conformity with the form of the backs 13, 14 and 15. The feeding of the conditioned air to the space to be air conditioned is effected from a non-illustrated pressure chamber of an air conditioning plant through an air passage 26, the supports 20 and 21, and the supporting beam 19 to tthe air funnels 23, 24 and 25, while the conditioned air leaves the wide openings of the air funnels 23, 24 and 25. Expediently, the wide openings of the air funnels are covered by a screen. The part of the supplied air is indicated by dash line.

Figure 2:
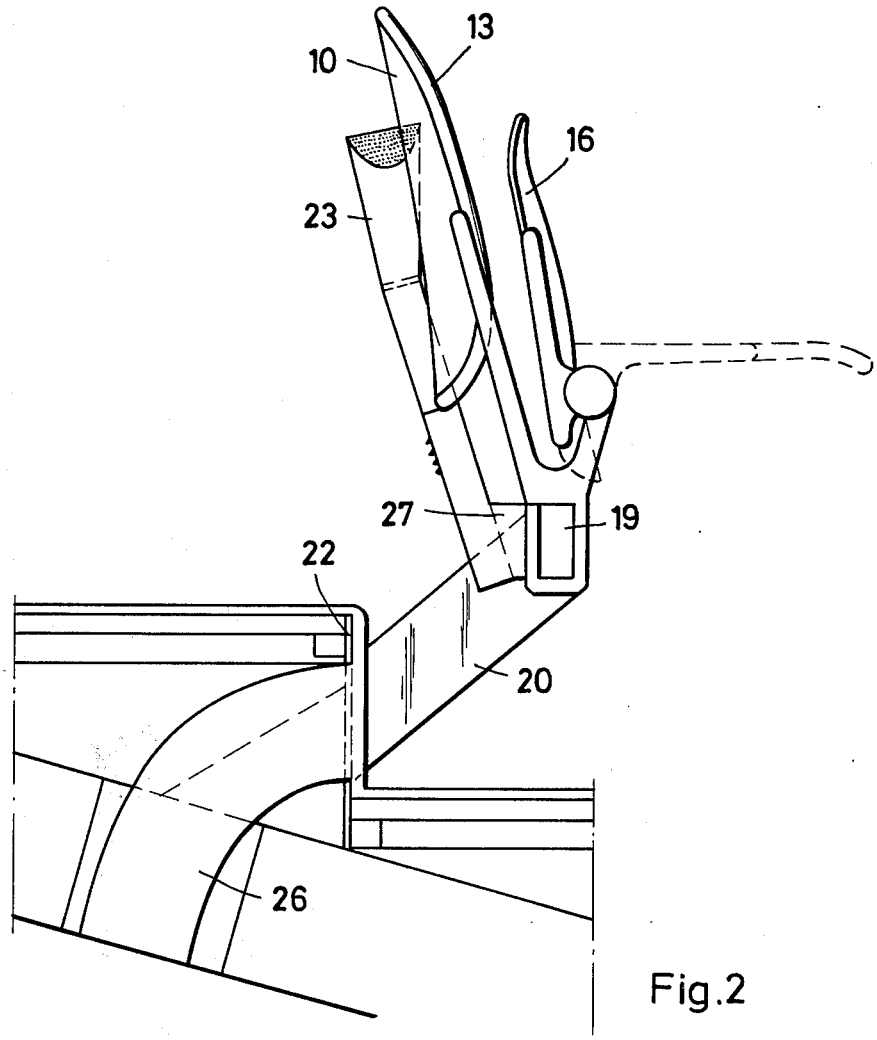
FIG. 2 shows a side view of an individual seat with air supply lines and an air outlet device.

FIG. 2 shows the arrangement of the air passage 26 and supports 20. Instead of the support 20 arranged at an incline on the stair step 22, also a support standing vertically on the floor and intended for the air supply to the supporting beams 19 may be provided if this should make possible a simpler connection to an air feeding passage.

Figure 3:
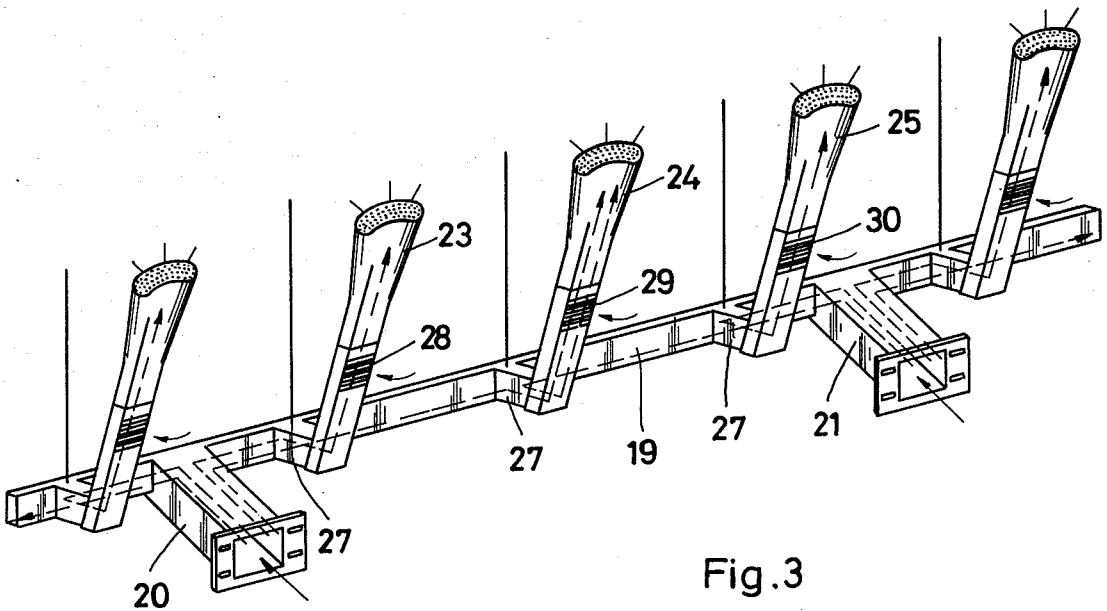
FIG. 3 illustrates an air supply system for a row of seats.

FIG. 3 shows once more the system of supply of air to the individual seats 10, 11 and 12. Mounted on the supporting beam 19 are air funnels 23, 24 and 25 for furnishing conditioned air. In order to assure a particularly good airing, on one side wall there are provided the air funnels 23, 24, 25, openings 28, 29 and 30, for adding secondary air to the conditioned air. The conditioned air draws in the secondary air in an injector-like manner and intermixes therewith. The mixture of conditioned air and secondary air will then leave the upper openings of the air funnels 23, 24 and 25, and enter the space to be air conditioned. The path of the conditioned air and of the admixed secondary air is indicated by dash lines.

It is, of course, to be understood that the present invention is, by no means, limited to the specific showing in the drawings, but also comprises any modifications within the scope of the appended claims.

What we claim is:

1. An arrangement in combination for distribution of conditioned air to a row of seats in a room: a horizontal supporting beam having structure defining air passage means therein extending in the longitudinal direction of said beam, a plurality of seats mounted in common on said beam, said beam being provided with inlet means for conditioned air, air outlet means arranged on said beam for communicating with said passage means, discharge opening means connected to said air outlet means for discharging conditioned air from the interior of said beam into the room in which said seats are located, hollow supporting means extending downwardly and connected to said beam while respectively supporting said beam, said hollow supporting means comprising conditioned air conveying means communicating directly with said passage means, and forming part of said air inlet means and arranged in spaced relationship to each other in the longitudinal direction of said supporting beam and respectively having one end connected to said supporting beam for communication with said passage means in said supporting beam and having the other end arranged for communication with a source of conditioned air.

2. An arrangement in combination according to claim 1, in which said air outlet means include a funnel-shaped section having an upper wider section forming the air outlet means proper and also having a lower narrower section closer to said supporting beam than said upper section.

3. An arrangement in combination according to claim 2, in which each of said seats has a back, and in which said air outlet means are respectively located between each two adjacent backs of said seats.

4. An arrangement in combination according to claim 3, in which said air outlet means are between their connection with said supporting means and their discharge opening means provided with air inlets for injection of secondary air.

* * * * *